US006362609B1

(12) United States Patent
Gailhard

(10) Patent No.: US 6,362,609 B1
(45) Date of Patent: Mar. 26, 2002

(54) VOLTAGE REGULATOR

(75) Inventor: Bruno Gailhard, Trets (FR)

(73) Assignee: STMicroelectronics S.A., Gentilly (FR)

( * ) Notice: Subject to any disclaimer, the term of this patent is extended or adjusted under 35 U.S.C. 154(b) by 0 days.

(21) Appl. No.: 09/658,337

(22) Filed: Sep. 8, 2000

(30) Foreign Application Priority Data

Sep. 10, 1999 (FR) ..... 99 11492

(51) Int. Cl.[7] ..... G05F 1/40
(52) U.S. Cl. ..... 323/280; 327/111
(58) Field of Search ..... 323/280, 281, 323/282, 283, 284, 313, 907; 327/100, 111, 261, 108

(56) References Cited

U.S. PATENT DOCUMENTS 4,424,456 A * 1/1984 Shiraki et al. ..... 327/111
5,001,484 A * 3/1991 Weiss ..... 341/153
5,861,737 A 1/1999 Goerke et al. ..... 323/282

FOREIGN PATENT DOCUMENTS

EP 0309922 9/1988 ..... G05F/1/565

OTHER PUBLICATIONS

Kmetz G L: "Soft–Start Regulator Starts at OV" EDN Electrical Design News, US, Cahners Publishing Co. Newton, Massachusetts, vol. 41, No. 12, Jun. 6, 1996, p. 104, 106.

* cited by examiner

*Primary Examiner*—Rajnikant B. Patel
(74) *Attorney, Agent, or Firm*—Lisa K. Jorgenson; Allen, Dyer, Doppelt, Milbrath & Gilchrist, P.A.

(57) ABSTRACT

A voltage regulator includes a capacitor providing a regulated voltage, a regulation switch for connecting the capacitor to a voltage source, and a regulation circuit for closing the regulation switch when the regulated voltage is below a first reference voltage. The voltage regulator also includes at least one ballast switch arranged in parallel with the regulation switch. The regulation circuit opens the regulation switch and closes the ballast switch during a starting phase of the regulator.

24 Claims, 2 Drawing Sheets

VOLTAGE REGULATOR

FIELD OF THE INVENTION

The present invention relates to electronics, and, more particularly, to a voltage regulator. The voltage regulator includes a capacitor providing a regulated voltage, a regulation switch for connecting the capacitor to a voltage source, and a regulation circuit for closing the regulation switch when the regulated voltage is below a first reference voltage.

BACKGROUND OF THE INVENTION

Voltage regulators have various applications in the field of electronics. For example, voltage regulators deliver regulated voltages to the external pins of a microprocessor. FIG. 1 shows a conventional voltage regulator 1 incorporated into a microprocessor 2. The microprocessor 2 is supplied with a battery 3 having an internal resistance ri and provides a voltage VDD.

The regulator 1 comprises an external capacitor CREG providing, on its anode, a regulated voltage VREG. The anode of the capacitor CREG is coupled to the anode of the battery 3 by a regulation switch SW1 presenting a serial resistance R1 equal to zero or a small value. The switch SW1 is driven by the output of a follower circuit CP which receives the regulated voltage VREG on its positive input and a reference voltage VREF on its negative input.

The voltage VREF is conventionally a band-gap voltage, and presents good stability versus temperature, and is generated by PN junction diodes and current mirrors. The follower circuit CP is controlled by a signal PDW (Power-Down) and the anode of the capacitor CREG is coupled to ground by a switch SWOFF driven by the signal PDW. When the signal PDW is equal to 1, the follower circuit CP is OFF and the switch SWOFF is closed. The regulator 1 is stopped and the capacitor CREG is discharged.

The drawback of such a regulator is that it presents a high current consumption at start-up. When the signal PDW is set to 0, the capacitor CREG is discharged and the voltage VREG is equal to zero. The output of the follower circuit CP passes to 0 and the switch SW1 closes. The application of the voltage VDD to the capacitor CREG causes a high current drain and a significant drop of the voltage supply VDD of the microprocessor 2 because of the internal resistance ri of battery 3. If, at the same moment, other elements of the microprocessor 2 consume non-negligible current levels, it may occur that the voltage VDD becomes less than the minimal working voltage of the microprocessor 2 so that microprocessor 2 will not operate.

SUMMARY OF THE INVENTION

In view of the foregoing background, an object of the present invention is to limit the starting current of a voltage regulator without increasing the serial resistance of the regulation switch.

This and other objects, advantages and features are provided by a voltage regulator of the above described type comprising at least one ballast switch arranged in parallel with the regulation switch, and a circuit for opening the regulation switch and closing the ballast switch at least during a starting phase of the voltage regulator until the capacitor is at least partially charged.

According to one embodiment, the voltage regulator comprises a circuit for opening the regulation switch and for closing the ballast switch when the regulated voltage is below a second reference voltage lower than the first reference voltage. The second reference voltage is preferably a fraction of the first reference voltage.

A common control signal for the regulation switch and the ballast switch is preferably applied to the regulation switch by an inhibiting switch. The inhibiting switch is driven by a signal delivered by a comparator receiving as inputs the regulated voltage and a second reference voltage lower than the first reference voltage.

According to another embodiment, the voltage regulator comprises a follower circuit receiving as inputs the regulated voltage and the first reference voltage. The follower circuit delivers a regulation signal, and a comparator receives as inputs the regulated voltage and a second reference voltage lower than the first reference voltage. The regulation signal is applied to the control input of the ballast switch and to the control input of the regulation switch by an inhibiting switch. The output of the comparator is applied to the control input of the inhibiting switch.

The ballast switch is preferably a MOS transistor comprising a non-negligible intrinsic resistance. The voltage source is preferably an electric battery.

Another feature of the present invention relates to an integrated circuit comprising a voltage regulator as disclosed herein.

BRIEF DESCRIPTION OF THE DRAWINGS

These objects, characteristics and advantages of the present invention will be described with more details in the following description of a voltage regulator according to the present invention, in conjunction with the accompanying drawings, in which.

DETAILED DESCRIPTION OF THE PREFERRED EMBODIMENTS

Figure 1:
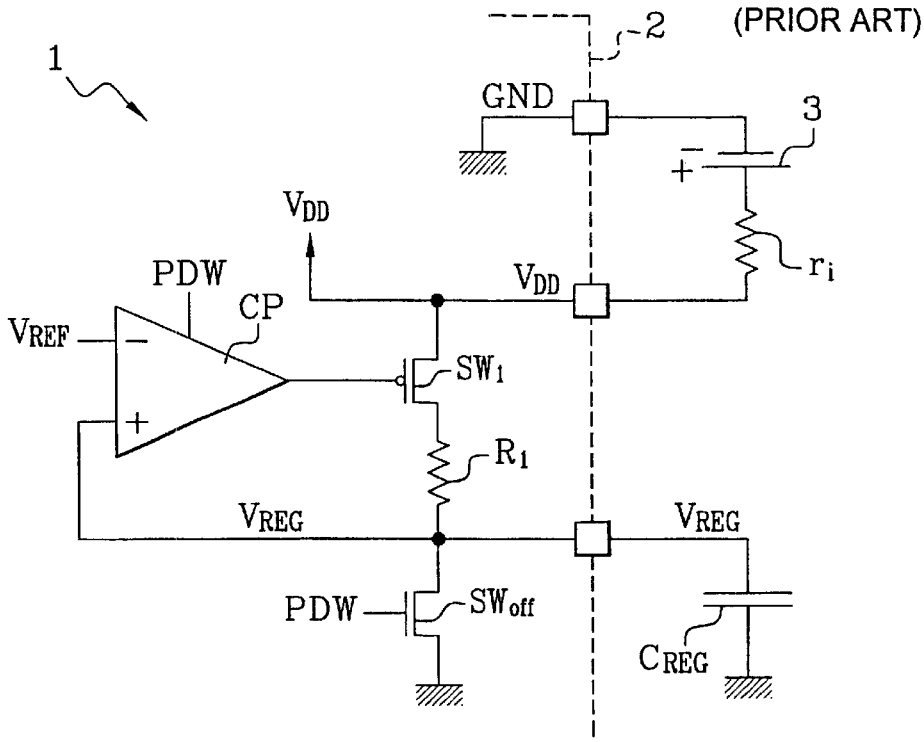
FIG.1 (PRIOR ART)
FIG. 1 is an electrical diagram of a voltage regulator according to the prior art.
Figure 2:
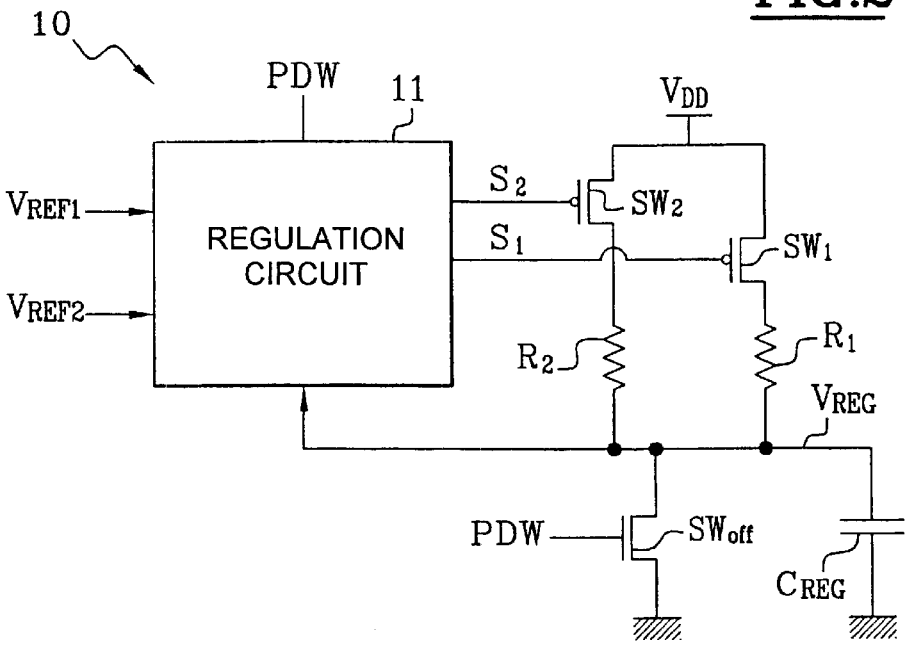
FIG. 2 is an electrical diagram of a voltage regulator according to the present invention.

FIG. 2 shows a voltage regulator according to the present invention. The voltage regulator 10 conventionally comprises a capacitor CREG whose anode is coupled to a voltage source VDD by a regulation switch SW1. The regulation switch SW1 may be a PMOS transistor, and includes a serial resistance R1 connected thereto. The serial resistance R1 is equal to zero or a small value. The anode of the capacitor CREG, which delivers a regulated voltage VREG, is coupled to ground by a switch SWOFF driven by a reset signal PDW (Power-Down).

According to the invention, a ballast switch SW2 is connected in parallel with the switch SW1. The switch SW2 presents a non-negligible serial resistance R2 of a few hundred ohms, for example. The switch SW2 may be a PMOS transistor, and the resistance R2 is the intrinsic resistance of the transistor, i.e., its serial resistance (RON) in the ON state. The value of the resistance R2 is thus determined by the choice of the ratio W/L between the width W and the length L of the gate of the transistor.

The switches SW1, SW2 are driven by a circuit 11 that is controlled by the signal PDW. The circuit 11 receives as inputs the voltage VREG, a first reference voltage VREF1 and a second reference voltage VREF2. The voltage VREF2 is lower than VREF1 and is equal to 0.75 VREF1, for example. The circuit 11 delivers a signal S1 for controlling the switch SW1 and a signal S2 for controlling the switch SW2. The signals S1, S2 are applied to the respective gates of the PMOS transistors.

When the signal PDW is equal to 1, the circuit 11 is OFF and the switch SWOFF is closed. The capacitor CREG is discharged and the voltage VREG is equal to zero. When the signal PDW is set to 0, the circuit 11 starts and the capacitor CREG charges. Operation of the voltage regulator 10 and the circuit 11 will be described with reference to Table 1 below. The switches SW1, SW2 may be PMOS transistors, and the active value of the signals S1, S2 corresponding to the closing of the switches SW1, SW2 (ON state) is the value 0. That is, the gates of the transistors are connected to ground. When the signals S1, S2 are at 1 (voltage VDD), the switches are open. That is, the transistors are in the OFF state.

TABLE 1

| $V_{REG}$ | S1 | SW1 | S2 | SW2 |
|---|---|---|---|---|
| (E1) $V_{REG} < V_{REF2}$ | 1 | open | 0 | closed |
| (E2) $V_{REF2} < V_{REG} < V_{REF1}$ | 0 | closed | 0 or 1 | closed or open |
| (E3) $V_{REG} < V_{REF1}$ | 1 | open | 1 | open |

Thus, at the start-up of the voltage regulator 10, the capacitor CREG charges in two periods E1, E2. During the period E1, the ballast switch SW2 is closed and the regulation switch SW1 is open. The charge of the capacitor CREG is provided by the ballast switch SW2 and the starting current is limited by the resistance R2. The risk of an abrupt decrease of the voltage supply VDD is thus suppressed. In particular, this happens when the voltage VDD is provided by a battery or a voltage generator having a non-negligible internal resistance.

The period E2 occurs when the voltage VREG exceeds the threshold VREF2. The switch SW1 closes and the charge cycle of the capacitor CREG finishes rapidly. This occurs when the resistance R1 is equal to zero or a small value. During the period E2, the ballast switch SW2 may equally be maintained open or closed.

When the capacitor CREG is charged, the voltage regulator 10 operates in a conventional way. The regulation switch SW1 is closed (period E2) or open (period E3) depending on whether the voltage VREG is lower or higher than VREF1. The voltage VREG is thus controlled in the vicinity of VREF1, with alternation of the periods E2 and E3. During the over voltage periods E3, the ballast switch SW2 is always open.

Figure 3:
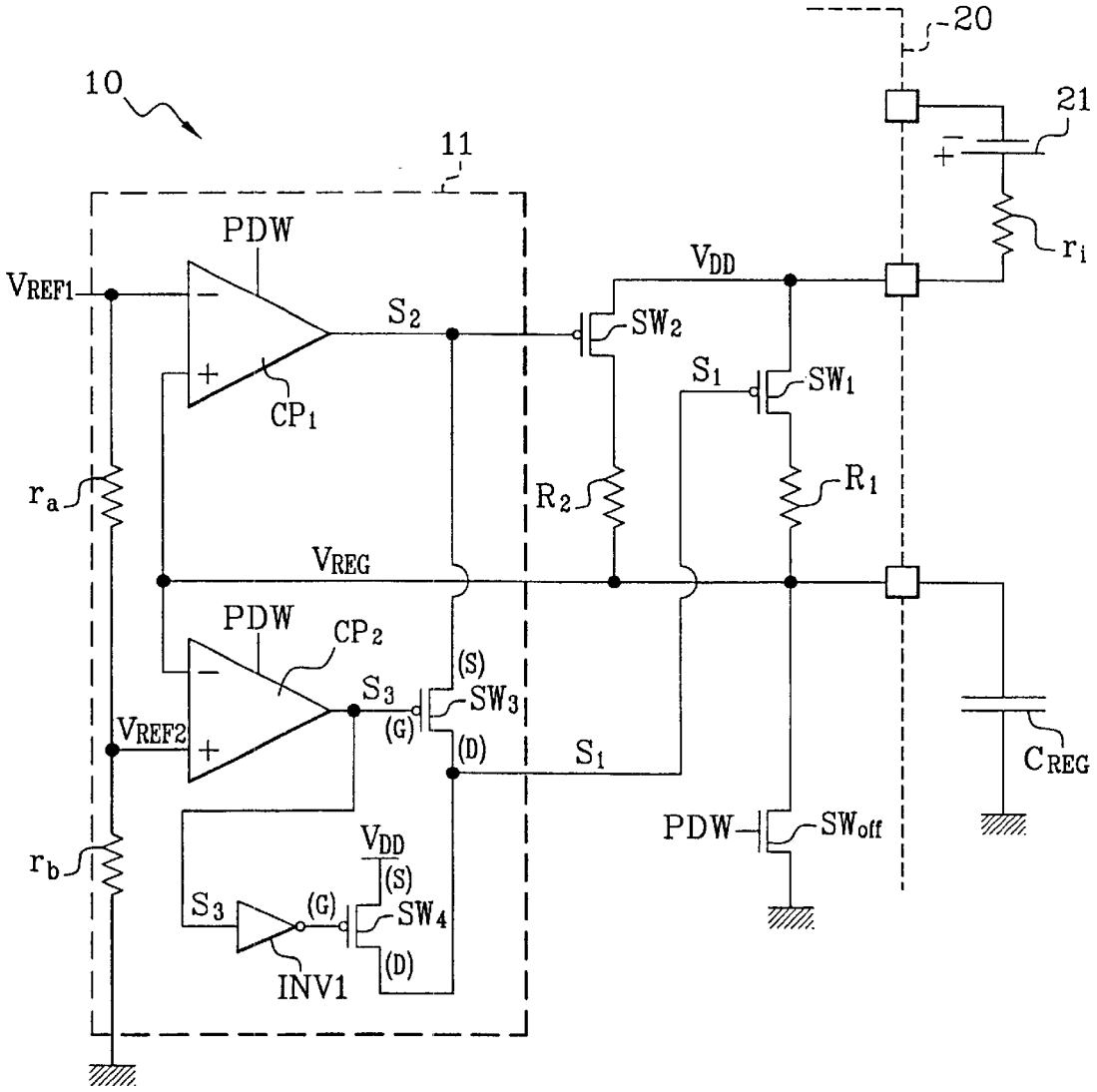
FIG. 3 is an electrical diagram of the voltage regulator according to the present invention incorporated within an integrated circuit.

An advantageous embodiment of the circuit 11 is represented in FIG. 3. In a nonlimiting way, the voltage regulator 10 is represented as being incorporated into an integrated circuit 20, such as a microprocessor for example. The voltage VDD is delivered by a battery 21 having an internal resistance ri.

The circuit 11 comprises an operational amplifier CP1 arranged as a follower circuit and a comparator CP2. The follower circuit CP1 and the comparator CP2 are controlled by the signal PDW. The follower circuit CP1 receives the voltage VREF1 on its negative input and the regulated voltage VREG on its positive input. The output of the follower circuit CP1 delivers the signal S2 which is applied to the control input of the switch SW2. The comparator CP2 receives the voltage VREF2 on its positive input and the voltage VREG on its negative input.

The voltage VREF2 is obtained by dividing the voltage VREF1 by a divider bridge comprising two resistances ra, rb. The output of the comparator CP2 delivers a signal S3 which is applied to the control input of a switch SW3, as well as to the input of an inverting gate INV1. The switch SW3 may be a PMOS transistor. The output of the gate INV1 is connected to the control input of a switch SW4, which may also be a PMOS transistor. The input of the switch SW4 (source) receives the voltage VDD and the input of the switch SW3 (source) receives the signal S2. The outputs of the switches SW3 and SW4 (drains) are connected together and deliver the signal S1 which is applied to the control input of the switch SW1.

Operation of the circuit 11, described with reference to Table 2 below, is equivalent to the operation described with reference to Table 1. During the first charge period E1 of the capacitor CREG, the signal S1 is equal to 0 and the signal S3 is equal to 1. The ballast switch SW2 is closed, the switch SW3 is open (transistor OFF) and the switch SW4 closed. The signal S1 is at 1 (voltage VDD) and the regulation switch SW1 is maintained open. During the second charge period E2, the signal S2 remains at 0, the signal S3 passes to 0, the switch SW3 closes and the switch SW4 opens. The signal S1 copies the signal S2 via the switch SW3 and the regulation switch SW1 closes.

TABLE 2

| $V_{REG}$ | S2 | SW2 | S3 | SW3 | SW4 | S1 | SW1 |
|---|---|---|---|---|---|---|---|
| (E1) $V_{REG} < V_{REF2}$ | 0 | closed | 1 | open | closed | 1 | open |
| (E2) $V_{REF2} < V_{REG} < V_{REF1}$ | 0 | closed | 0 | closed | open | 0 | closed |
| (E3) $V_{REG} > V_{REF1}$ | 1 | open | 0 | closed | open | 1 | open |

In Table 2, the switch SW3 is an inhibiting switch allowing, during the first charge period E1, the non-transmission of the regulation signal S2 to the switch SW1 so that the switch SW1 does not close. The switch SW4 is an auxiliary element providing that the gate of the switch transistor SW1 is prevented to be brought to a floating potential (high impedance) when the switch SW3 is open. Various alternatives are conceivable according to the operating modes of the switches, as will be readily appreciated by one skilled in the art. These switches may be either of a normally open type, of a normally closed type, or of a type which does not accept an indefinite signal on the control input.

This embodiment of the circuit 11 may also be subject to various alternatives regarding the control of the inhibiting switch SW3. For example, the signal S3 may be delivered by a timer activated at the starting of the voltage regulator 10, or may be delivered by the microprocessor 20 after running a temporary program. In this case, the regulation switch SW1 remains open until the signal S3 is set to 0 by the timer or the microprocessor. The duration of the temporary program must be calculated according to the capacity of the capacitor CREG.

This embodiment of the circuit 11 has the advantage of providing an automatic starting of the regulation switch SW1 when the threshold VREF2 is reached. This is regardless of what the capacity of capacitor CREG may be, and without the need of generating a temporary program signal by a timer or a program.

Another advantage is that the signal S3 delivered by the comparator CP2 may be used by the microprocessor to monitor the state of the regulator 10. For example, the passage to 1 of the signal S1 during operation is representative of an overload of the regulator. In some applications, the signal S3 may be logically combined to other signals emitted by the microprocessor before being applied to the inhibiting switch SW3 so that the microprocessor can force the regulation switch SW1 to the open or closed state if necessary.

Although it has been indicated here-above that the resistance R2 is the intrinsic resistance of the ballast switch SW2, it will be apparent that the term "ballast switch" may designate a switch with a resistance equal to zero connected in series with a resistance R2, or a switch with an intrinsic resistance R2*a* connected in series with an additional resistance R2*b*.

That which is claimed is:

1. A voltage regulator comprising:

a voltage source;

a capacitor for providing a regulated voltage;

a regulation switch for connecting said capacitor to said voltage source;

at least one ballast switch connected in parallel with said regulation switch; and a regulation circuit for closing said regulation switch when the regulated voltage is below a first reference voltage, and for opening said regulation switch and closing said ballast switch at least during a starting phase of the voltage regulator until said capacitor is at least partially charged.

2. A voltage regulator according to claim 1, wherein said regulation circuit opens said regulation switch and closes said ballast switch when the regulated voltage is below a second reference voltage lower than the first reference voltage.

3. A voltage regulator according to claim 1, wherein said regulation circuit further comprises an inhibiting switch, said regulation circuit providing a first common control signal to said ballast switch, and a second common control signal to said regulation switch via said inhibiting switch.

4. A voltage regulator according to claim 3, wherein said regulation circuit further comprises a comparator having inputs for receiving the regulated voltage and a second reference voltage lower than the first reference voltage, said comparator providing a driving signal for driving said inhibiting switch.

5. A voltage regulator according to claim 4, wherein said regulation circuit further comprises a fourth switch connected between said inhibiting switch and an output of said comparator.

6. A voltage regulator according to claim 1, wherein said regulation circuit further comprises:

an inhibiting switch;

a follower circuit having inputs for receiving the regulated voltage and the first reference voltage, and an output for delivering a regulation signal to be applied to a control input of said ballast switch, and to a control input of said regulation switch via said inhibiting switch; and a comparator having inputs for receiving the regulated voltage and a second reference voltage lower than the first reference voltage, and an output being connected to a control input of said inhibiting switch.

7. A voltage regulator according to claim 6, wherein said regulation circuit further comprises a fourth switch connected between said inhibiting switch and the output of said comparator.

8. A voltage regulator according to claim 1, wherein said ballast switch comprises a MOS transistor having a non-negligible intrinsic resistance.

9. A voltage regulator according to claim 1, wherein said voltage source comprises a battery.

10. An integrated circuit comprising:

a plurality of external pins comprising a capacitor pin for connecting to an external capacitor providing a regulated voltage, and a voltage source pin for connecting to a voltage source; and a voltage regulator comprising a regulation switch for connecting said capacitor pin to said voltage source pin, at least one ballast switch connected in parallel with said regulation switch, and a regulation circuit for closing said regulation switch when the regulated voltage is below a first reference voltage, and for opening said regulation switch and closing said ballast switch at least during a starting phase of the voltage regulator until the external capacitor is at least partially charged.

11. An integrated circuit according to claim 10, wherein said regulation circuit opens said regulation switch and closes said ballast switch when the regulated voltage is below a second reference voltage lower than the first reference voltage.

12. An integrated circuit according to claim 10, wherein said regulation circuit further comprises an inhibiting switch, said regulation circuit providing a first common control signal to said ballast switch, and a second common control signal to said regulation switch via said inhibiting switch.

13. An integrated circuit according to claim 12, wherein said regulation circuit further comprises a comparator having inputs for receiving the regulated voltage and a second reference voltage lower than the first reference voltage, said comparator providing a driving signal for driving said inhibiting switch.

14. An integrated circuit according to claim 13, wherein said regulation circuit further comprises a fourth switch connected between said inhibiting switch and an output of said comparator.

15. An integrated circuit according to claim 10, wherein said regulation circuit further comprises:

an inhibiting switch;

a follower circuit having inputs for receiving the regulated voltage and the first reference voltage, and an output for delivering a regulation signal to be applied to a control input of said ballast switch, and to a control input of said regulation switch via said inhibiting switch; and a comparator having inputs for receiving the regulated voltage and a second reference voltage lower than the first reference voltage, and an output being connected to a control input of said inhibiting switch.

16. An integrated circuit according to claim 15, wherein said regulation circuit further comprises a fourth switch connected between said inhibiting switch and the output of said comparator.

17. An integrated circuit according to claim 10, wherein said ballast switch comprises a MOS transistor having a non-negligible intrinsic resistance.

18. An integrated circuit according to claim 10, wherein the integrated circuit is a microprocessor.

19. A method for regulating a voltage using a voltage regulator comprising a voltage source, a capacitor for providing a regulated voltage, and a regulation switch for connecting the capacitor to the voltage source, and at least one ballast switch connected in parallel with the regulation switch, the method comprising:

closing the regulation switch when the regulated voltage is below a first reference voltage; and opening the regulation switch and closing the ballast switch at least during a starting phase of the voltage regulator until the capacitor is at least partially charged.

20. A method according to claim 19, wherein the regulation switch is opened and the ballast switch is closed when the regulated voltage is below a second reference voltage lower than the first reference voltage.

21. A method according to claim 19, wherein the voltage regulator further comprises an inhibiting switch; the method further comprising:

providing a first common control signal to the ballast switch; and a second common control signal to the regulation switch via the inhibiting switch.

22. A method regulator according to claim 21, wherein the voltage regulator further comprises a comparator having inputs for receiving the regulated voltage and a second reference voltage lower than the first reference voltage, and an output for providing a driving signal; the method further comprising driving the inhibiting switch via the driving signal.

23. A method regulator according to claim 19, the voltage regulator further comprising an inhibiting switch; a follower circuit having inputs for receiving the regulated voltage and the first reference voltage, and an output for delivering a first regulation signal; and a comparator having inputs for receiving the regulated voltage and a second reference voltage lower than the first reference voltage, and an output for delivering a second regulation signal; the method further comprising:

applying the first regulation signal to a control input of the ballast switch, and to a control input of the regulation switch via the inhibiting switch; and applying the second regulation signal to a control input of the inhibiting switch.

24. A method according to claim 19, wherein the ballast switch comprises a MOS transistor having a non-negligible intrinsic resistance.

* * * * *

UNITED STATES PATENT AND TRADEMARK OFFICE

CERTIFICATE OF CORRECTION

PATENT NO. : 6,362,609 B1
DATED : March 26, 2002
INVENTOR(S) : Bruno Gailhard

It is certified that error appears in the above-identified patent and that said Letters Patent is hereby corrected as shown below:

Column 7,
Line 17, delete "method regulator according" insert -- method according --

Column 8,
Line 1, delete "method regulator according" insert -- method according --

Signed and Sealed this

First Day of October, 2002

*Attest:*

*Attesting Officer*

JAMES E. ROGAN
*Director of the United States Patent and Trademark Office*